United States Patent [19]

Maul

[11] 4,161,071

[45] Jul. 17, 1979

[54] SNOWSHOE

[76] Inventor: Fritz Maul, 3768 S. 189th Pl., Seattle, Wash. 98188

[21] Appl. No.: 831,802

[22] Filed: Sep. 9, 1977

[51] Int. Cl.[2] ..... A43B 5/04

[52] U.S. Cl. ..... 36/125

[58] Field of Search ..... 36/122, 123, 124, 125

[56] References Cited

U.S. PATENT DOCUMENTS

| | | | |
|---|---|---|---|
| 982,053 | 1/1911 | Haefer | 36/125 |
| 2,182,375 | 12/1939 | Erdman | 36/7.7 |
| 2,769,250 | 11/1956 | Rinkinen | 36/124 |
| 3,555,707 | 1/1971 | Sharratt et al. | 36/123 |
| 4,041,621 | 8/1977 | Anderson | 36/122 |

*Primary Examiner*—Patrick D. Lawson

*Attorney, Agent, or Firm*—Charles L. Kraft, II

[57] ABSTRACT

The snowshoe employs a configuration in which the binding is mounted asymmetrically with respect to the rectilinear centerline of a snowshoe frame. Typically, the binding herein will be mounted in a relationship wherein the centerline of the binding is disposed with one and a half times as much area of the snowshoe on the outboard side as the inboard. Other adaptations herein include angular juxtapositions of the binding to compensate for pigeon-toedness and similar foot disorders.

6 Claims, 2 Drawing Figures

SNOWSHOE

FIELD OF INVENTION

The present invention relates to snowshoes.

BRIEF DESCRIPTION OF THE PRIOR ART

Snowshoes heretofore have universally employed binds which are mounted in alignment with the rectilinear centerline of the snowshoe frame. This is an unnatural design when taking into account the configuration of the foot which since the foot is asymmetrical, asymmetrical snowshoe is clumsy and does not receive load property.

It is also conventional to mount a snowshoe binding only in alignment with the centerline of the shoe. Since not all persons walk with their feet posed straight ahead, some persons find snowshoes uncomfortable or useless.

Shoes have typically been fabricated in a rigid, unchangeable size. Requirements of floatation change with snow conditions, conventional shoe construction requires the shoer to change his pace, or carry additional pairs of varying sizes.

Accordingly, it is a primary object of this invention to provide a snowshoe having an asymmetrical orientation of its binding with respect to the centerline of the shoe. It is a corrolary further object that the binding be mounted with the same relative area of floatation with respect to the snowshoe as the foot.

It is still another object of the orientation of the rectilinearly centerline of the binding be changeable with respects to the rectilinear centerline of the snowshoe.

It is an object that the area of the snowshoe be changeable.

These and other objects shall become apparent from the description following, it being understood that modifications may be made without affecting the teachings of the invention here set out.

SUMMARY OF INVENTION

The snowshoe employs a configuration in which the binding is mounted asymmetrically with respect to the rectilinear centerline of a snowshoe frame. Typically, the binding herein will be mounted in a relationship wherein the centerline of the binding is disposed with one and a half times as much area of the snowshoe on the outboard side as the inboard. Other adaptations herein include angular juxtapositions of the binding to compensate for pigeon-toedness and similar foot disorders.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
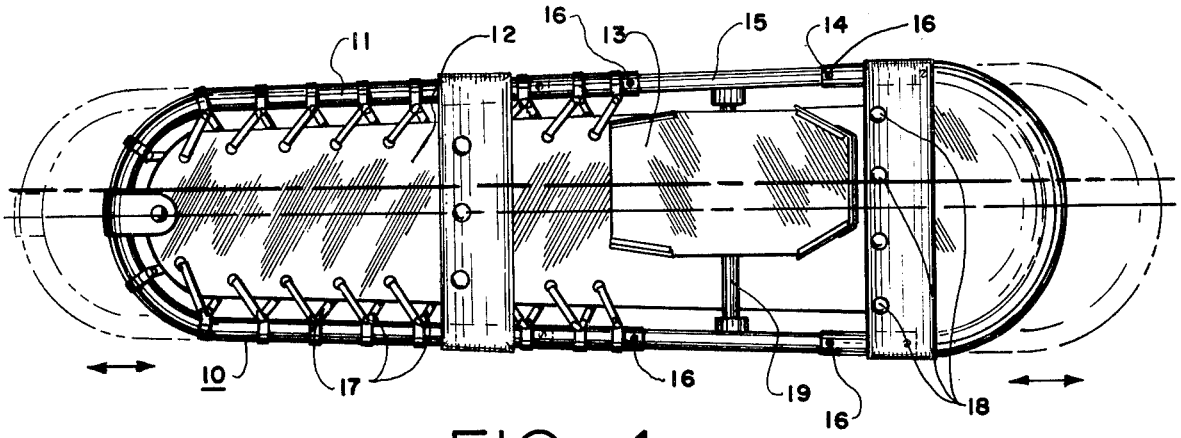
FIG. 1 is a top plan view of the snowshoe of my invention shown with portions of its tubular frame in their extended position, in broken lines for illustrative purposes.

Referring now to the drawings and more particularly to the FIG. 1, the snowshoe of the present invention is shown to advantage generally identified by the numeral 10. The snowshoe comprises a frame 11, a webbing 12, and a binding 13.

The frame 11 defines the outer configuration of the snowshoe. In the present embodiment, the frame 11 is fabricated of tubular sections 14 and 15 which have a generally U-shaped configuration. Sections 14 and 15 are intended to engage one in the other in an opposing fashion to provide a closed geometric space. It is to be understood that although the embodiment shown in the drawings has an oval shape, other configurations derive similar results. The tubular sections 14 and 15 are fastened by means such as a lock screw 16 disposed through the respective terminal ends of the section 15 to engage complimentary portions of the section 14. It has been found to advantage to incline the forward section 14 upwardly to facilitate walking. This structure of frame may be adjusted to varying lengths or collapsed entirely for storage.

The webbing 12 may be of a number of types including a sheet webbing, shown in the drawings, latice webbing, or similar construction which will produce floatation on snow. The webbing 13 is joined to the frame 11 by means such as lacings 17 and grommet fasteners 18. In the extensible embodiment described herein, grommets at the forward portion of the webbing may be employed to engage complimentary fastener components carried on the tubular section 14 to produce a webbing of substantially the same size and configuration as the frame 11 at its various sizes.

The binding 13 may be fabricated of a number of types including fixed and piveting bindings. As an example, an improved step-in binding 13 which is mounted on a shaft 19. The shaft 19 is disposed generally transversely of and fastened to the frame 11. The binding 13 comprises a bottom plate 20 which is fastened to bushings (not shown) which mount the binding 13 to the shaft 19, welt engaging brackets 21 which issue upwardly at the forward portion of the plate 19, and retaining plates 22 which engage each side of the middle portion of a boot. It may be seen that the parts 21 and 22 may be mounted to the bottom plate 20 by means of locking screws 23 and slots 24. The screws 23 may project below the plate 20 to provide a crampon.

Figure 2:
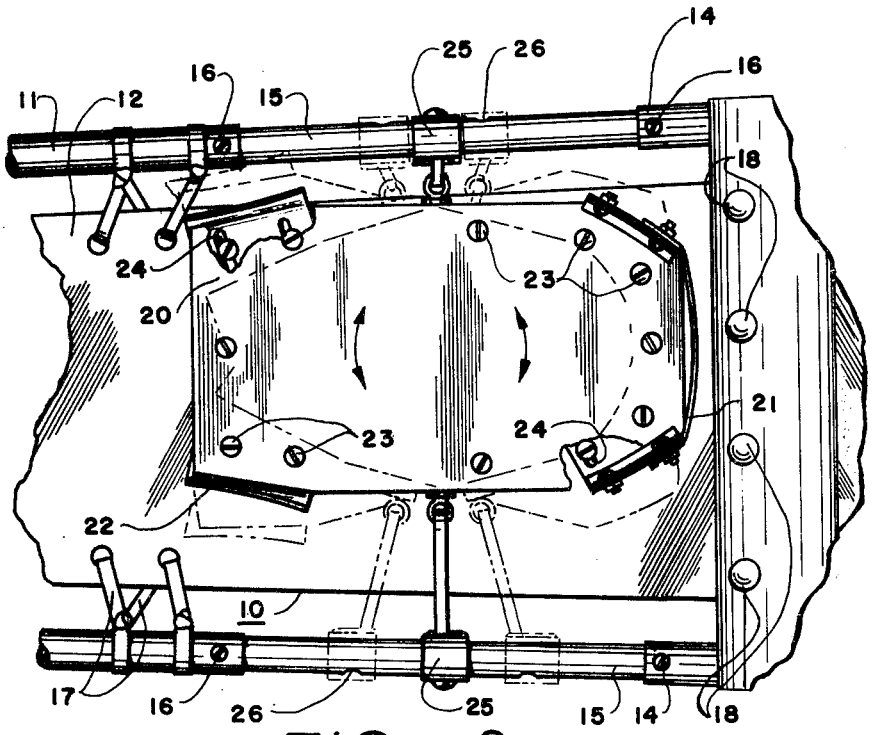
FIG. 2 is a fragmenting top plan of the snowshoe shown with the binding drawn in secondary positions, in broken lines to be illustrative of adjustments which may be made.

Referring to the FIG. 2, it has been found of great advantage to make the angle of orientation between the rectilinear centerline of the binding 13 and the rectilinear centerline of the frame 11 adjustable to accommodate variations in the hiker's foot construction, e.g., pigeon-toedness. The shaft 19 is secured by slidable locking brackets 25. The brackets are provided with a multiplicity of hole 26 through which the shaft 18 may be disposed to produce a desired angle of orientation.

Referring again to the FIG. 1, a primary feature of the present snowshoe 10 employs a relationship between the juxtaposition of the rectilinear centerline of the binding 13 and rectilinear centerline of the frame 11. It is intended that this relationship of centerlines provide a relationship of area within the frame 11 and application of load at the binding 13 wherein the area from the rectilinear centerline of the binding 13 to the outboard side of the frame 11 is one and a half (1.5) times the area defined by the rectilinear centerline of the binding 13 and the inboard side of the frame 11. The definition of inboard and outboard will be opposite with right and left snowshoes.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. In a snowshoe having a frame defining the outer perimeter configuration of said snowshoe, a webbing mounted to said frame and suitably covering the interior area defined by said frame, and a binding mounted to said frame, the improvement of: mounting said binding asymmetrically with respect to the rectilinear centerline of said frame.

2. The snowshoe of claim 1 wherein the relationship of a symmetry between said binding and the rectilinear centerline of said snowshoe frame provides a relative area between the inboard and outboard sides of said frame wherein the area between the rectilinear centerline of said binding and the outboard side of said frame is one and half times the area defined by the rectilinear centerline of said binding and said frame.

3. The snowshoe of claim 1 wherein the rectilinear centerline of said shoe is mounted parallelly with respect to said rectilinear centerline of said frame.

4. The snowshoe of claim 1 wherein said binding is mounted with its rectilinear centerline at an angular orientation to the rectilinear centerline of said frame.

5. The snowshoe of claim 1 wherein said binding is mounted on means for adjusting the angular relationship of the rectilinear centerline of said binding and the rectilinear centerline of said snowshoe frame.

6. The snowshoe of claim 1 wherein said snowshoe frame comprises a pair of U-shaped tubular sections wherein legs of said sections telescope one into the other in an opposing fashion, means locking said tubular sections and wherein said webbing may be secured in a taut relationship with said frame at various degrees of extension of said sections.

* * * * *